US007687218B2

(12) United States Patent
Yang et al.

(10) Patent No.: US 7,687,218 B2
(45) Date of Patent: Mar. 30, 2010

(54) SILICONE WAX-CONTAINING TONER PARTICLES WITH CONTROLLED MORPHOLOGY

(75) Inventors: Xiqiang Yang, Webster, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 307 days.

(21) Appl. No.: 11/777,315

(22) Filed: Jul. 13, 2007

(65) Prior Publication Data

US 2009/0017396 A1 Jan. 15, 2009

(51) Int. Cl.
*G03G 9/13* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 4,833,060 | A | 5/1989 | Nair et al. | |
| 4,965,131 | A * | 10/1990 | Nair et al. | 430/110.2 |
| 5,283,151 | A | 2/1994 | Santilli | |
| 5,876,894 | A | 3/1999 | Leclair | |
| 5,968,702 | A | 10/1999 | Ezenyilimba et al. | |
| 6,380,297 | B1 | 4/2002 | Zion et al. | |
| 6,416,921 | B1 | 7/2002 | Wilson et al. | |
| 2003/0162112 | A1 | 8/2003 | Yamashita et al. | |
| 2004/0209181 | A1 | 10/2004 | Higuchi et al. | |
| 2007/0048642 | A1 * | 3/2007 | Hsieh | 430/108.1 |
| 2008/0090163 | A1 * | 4/2008 | Agur et al. | 430/108.1 |

* cited by examiner

*Primary Examiner*—John L Goodrow
(74) *Attorney, Agent, or Firm*—Carl F. Ruoff; Andrew J. Anderson

(57) ABSTRACT

The present invention is a method for the preparation of electrostatographic toner including the following steps. A first dispersion is prepared with a solvent, a silicone wax, and a hyperdispersant. The first dispersion is added to an organic solvent containing a polymer material to form an organic phase. The organic phase is dispersed in an aqueous phase containing a particulate stabilizer to form a second dispersion. The second dispersion is homogenized. The organic solvent is evaporated from the second dispersion and the resultant product is recovered, washed and dried. In an alternate method the hyperdispersant is added directly to the organic phase before mixing with the aqueous phase.

20 Claims, No Drawings

SILICONE WAX-CONTAINING TONER PARTICLES WITH CONTROLLED MORPHOLOGY

FIELD OF THE INVENTION

This invention relates to a method for the preparation of polymeric powders suitable for use as electrostatographic toner, and more particularly, to a method for the preparation of silicone wax-containing toner particles of controlled shape, in which certain commercially available hyperdispersants are employed for controlling morphology of the toner particles.

BACKGROUND OF THE INVENTION

Electrostatic toner polymer particles can be prepared by a process frequently referred to as "limited coalescence." In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al.

As with other emulsion related techniques, toner particles prepared with the limited coalescence process generally tend to be spherical in shape. On the other hand, conventional toners produced with the pulverizing technique, or commonly referred to as "ground toners," are of irregular surface morphology. There have been efforts to manufacture irregular shaped toner particles with the limited coalescence process. U.S. Pat. No. 5,283,151 is representative of earlier work in this field and describes the use of carnauba wax to achieve similar toner morphology. The method comprises the steps of dissolving carnauba wax in ethyl acetate heated to a temperature of at least 75° C. and cooling the solution, so resulting in the precipitation of the wax in the form of very fine needles a few microns in length; recovering the wax needles and mixing them with a polymer material, a solvent and optionally a pigment and a charge control agent to form an organic phase; dispersing the organic phase in an aqueous phase comprising a particulate stabilizer and homogenizing the mixture; evaporating the solvent and washing and drying the resultant product.

Unfortunately, this technique requires the use of elevated temperature to dissolve the wax in the solvent and cooling the solution to precipitate the wax. The wax does not stay in solution of ethyl acetate at ambient temperature and as a result it is very difficult to scale up using this methodology.

The shapes of the toner particles are important to the performance of an electrostatic toner such as transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toner particles by means other than the choice of pigment, binder, or charge agent. The shape of the toner particles is modified to enhance the cleaning and transfer properties of the toner.

U.S. Pat. No. 5,968,702 discloses a method of employing commercially available SOLSPERSE hyperdispersants, such as SOLSPERSE 24000 or 20000, in the organic phase in the evaporative limited coalescence process. Toner particles of controlled morphology can be obtained.

However, it is now found that the use of these hyperdispersants may lead to toner particles of unstable charge. Particularly, when negative charging is desired, toner particles obtained using SOLSPERSE 24000 as the shape control agent some times exhibit positive or erratic tribo-charging. Unpredictable and unstable charging behavior of a toner is unacceptable in electrophotography using dry toner powder, where a uniform and stable charge of the toner particles is required. The use of SOLSPERSE hyperdispersant as shape control agents for electrostatic toner manufacture is not practical without other inventions.

U.S. Pat. No. 6,380,297 describes the use of commercially available surfactants in controlling toner shape. These shape-modifying agents are used after the homogenization step, and therefore an additional step of introducing these agents to the homogenized emulsion is necessary.

U.S. Pat. No. 6,416,921 to Wilson et al. describes the use of quaternary ammonium tetraphenylborate salts and a polymeric phosphonium salt for controlling morphology of the toner particles. These polymeric materials generally yield irregularly shaped toner particles while maintaining acceptable charging behavior.

On the other hand, the incorporation of release agents, such as wax materials, has been employed in the art for oil-less fusing. U.S. Pat. No. 5,876,894 discloses the use of a silicone wax as release agent in an electrostatic toner.

It is now discovered unexpectedly by the present inventors that the combination of SOLSPERSE hyperdispersants and a commercial silicone wax can lead to toner particles with stable negative charging behavior. The silicone wax also functions as a release agent, enabling the toner to be used in oil-less fusing electrographic applications.

SUMMARY OF THE INVENTION

The present invention is a method for the preparation of electrostatographic toner including the following steps. A first dispersion is prepared with a solvent, a silicone wax, and a hyperdispersant. The first dispersion is added to an organic solvent containing a polymer material to form an organic phase. The organic phase is dispersed in an aqueous phase containing a particulate stabilizer to form a second dispersion. The second dispersion is homogenized. The organic solvent is evaporated from the second dispersion and the resultant product is recovered, washed and dried. In an alternate method the hyperdispersant is added directly to the organic phase before mixing with the aqueous phase.

DETAILED DESCRIPTION OF THE INVENTION

In accordance with the present invention, a silicone wax dispersion is prepared in an organic solvent such as ethyl acetate by milling in the presence of a dispersant. A pigment dispersion is prepared by conventional techniques as, for example, by media milling, melt dispersion and the like. The wax dispersion, a pigment, polymer material, a solvent, and optionally a charge control agent are combined to form an organic phase in which the pigment concentration ranges from about 4% to 20%, by weight, based on the total weight of solids, the wax concentration ranges from about 2% to about 15%, by weight, based upon the total weight of solids. The charge control agent can be employed in an amount ranging from 0 to 10 parts per hundred by weight, based on the total weight of solids, with a preferred range from 0.2 to 3.0 parts per hundred. This mixture is permitted to stir overnight and then dispersed in an aqueous phase comprising a particulate stabilizer and optionally a promoter.

The solvents chosen for use in the organic phase preparation steps may be selected from among any of the well-known solvents capable of dissolving polymers. Typical of the solvents chosen for this purpose are those with limited solubilities in water, such as chloroform, dichloromethane, methyl acetate, ethyl acetate, vinyl chloride, methyl ethyl ketone, and the like.

The particulate stabilizer selected for use in the aqueous phase herein may be selected from among highly cross-linked polymeric latex materials of the type described in U.S. Pat. No. 4,965,131 to Nair et al., or silicon dioxide. Silicon dioxide is preferred. Commercially available silicon dioxide in the form of aqueous (colloidal) dispersions is preferentially employed, such as LUDOX (30 nm) from DuPont, and NALCO 1060 (60 nm) from Nalco Chemical Company. The amount of the silica used generally ranges from 1 to 15 parts by weight based on 100 parts by weight of the total solids of the toner employed. However, the size and concentration of these stabilizers control and predetermine the size of the final toner particles. In other words, the smaller the size and/or the higher the concentration of such particles, the smaller the size of the final toner particles. When silicon dioxide is used, it may be optionally removed from the final toner by treatment with a strong base.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxymethylcellulose, tetramethyl ammonium hydroxide or chloride, diethylaminoethyl methacrylate, water soluble complex resinous amine condensation products of ethylene oxide, urea and formaldehyde and polyethyleneimine. Also, effective for this purpose are gelatin, casein, albumin, gluten and the like or non-ionic materials such as methoxycellulose. The promoter is generally used in an amount from about 0.2 to about 0.6 parts per 100 parts, by weight, of aqueous solution.

In one embodiment of the present invention, hyperdispersants that are useful shape control agents such as SOLSPERSE 24000 or 9000 hyperdispersants, sold by Noveon, can be added into the organic phase during the toner preparation process. Such methods for shape control of the final toner particles have been disclosed in U.S. Pat. No. 5,968,702, which is incorporated herein by reference.

In another embodiment of the present invention, these hyperdispersants are used as dispersing agents in the preparation of wax solid particle dispersions. The wax dispersion is then introduced into the organic phase. The amount of hyperdispersant when used as wax dispersing agent is generally from about 5 to about 25 percent by weight based on the wax, and preferably from about 10 to about 20 percent by weight with respect to the wax.

Wax is widely employed in electrostatic toner particles as release agent for oil-less fusing applications. Generally, waxes of many different types and of different origins are useful and well-known in the art. Usable release agents in the art are low-molecular weight polyolefins such as polyethylene, polypropylene and polybutene; silicone resins which can be softened by heating; fatty acid amides such as oleamide, erucamide, ricinoleamide and stearamide; vegetable waxes such as carnauba wax, rice wax, candelilla wax, Japan wax and jojoba oil; animal waxes such as bees wax; mineral and petroleum waxes such as montan wax, ozocerite, ceresine, paraffin wax, microcrystalline wax and Fischer-Tropsch wax; and modified products thereof. Silicone waxes have not been widely used in toner applications. The silicone waxes that were found to be useful release agent in the present invention are of cosmetic origin such as AMS-C30, available from Dow Corning Corporation.

Another silicone wax useful in the present invention is Dow Corning 2-5088. Generally, these waxes are used in the amount of from about 2 to about 15 percent by weight based on the toner, and more preferably from about 4 to about 10 percent by weight based on the toner.

Besides the wax, various other additives generally present in an electrostatograhic toner may be added to the polymer prior to dissolution in the solvent or in the dissolution step itself, such as charge control agents. Suitable charge control agents are disclosed, for example, in U.S. Pat. Nos. 3,893,935 and 4,323,634 to Jadwin et al. and U.S. Pat. No. 4,079,014 to Burness et al., and British Patent No. 1,420,839 to Eastman Kodak. Charge control agents are generally employed in small quantities such as from about 0.01 to 10 parts per hundred by weight based upon the weight of the total solids content (weight of the toner) and preferably from about 0.2 to about 3.0 parts per hundred.

The resultant mixture from the organic and aqueous phases is then subjected to higher shear mixing or homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume may range from 1:1 to approximately 9:1. This indicates that the organic phase is typically present in an amount from about 10% to 50% of the total homogenized volume.

Following the homogenization treatment the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins; polytetrafluoroethylene and polytrifluorochloroethylene; polyamides, such as poly(hexamethylene adipamide), poly(hexamethylene sebacamide), and polycaprolactam; acrylic resins, such as poly(methyl methacrylate), poly(methyl acrylate), poly(ethyl methacrylate) and poly(styrene-methyl methacrylate); ethylene-methyl acrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as $TiO_2$, carbon black and the like. Typical of the phthalocyanine pigments are copper phthalocyanine, a mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118, azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to provide an amount in the toner of from about 1% to 40%, by weight, based upon the weight of the toner, and preferably within the range of 4% to 20%, by weight.

The shape of the toner particles is an important factor influencing the transfer and cleaning properties of the electrostatic toner. In the practice of the present invention, SOLSPERSE hyperdispersants as shape control agents are preferably employed in the oil phase. The SOLSPERSE agents may be added directly to the oil phase, or they are first used as dispersing agents in the silicone wax dispersion preparation. In either case the amount of the SOLSPERSE agent used generally ranges from about 0.1 to about 2 percent by weight base on the total weight of the toner. Preferably they are used in the amount of about 0.5 to about 1.5 percent by weight. As was also taught in U.S. Pat. No. 5,968,702, the entire disclosure of which is incorporated herein by reference, the irregularity of toner shape is directly proportional to the amount of SOLSPERSE employed. Thus the exact amount of the SOLSPERSE agent employed may be fine-tuned further according to the desired reduction in sphericity for the final particles. Particularly useful shape control agents are disclosed in U.S. Pat. Nos. 6,416,921, 5,968,702, 6,380,297, and 5,041,625, the disclosures of which are hereby incorporated by reference.

Toner particles of the present invention may also contain flow aids in the form of surface treatments. Surface treatments are typically in the form of inorganic oxides or polymeric powders with typical particle sizes of 5 nm to 1000 nm. With respect to the surface treatment agent also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 5 weight percent, and most preferably from about 0.1 to about 3 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, such as R-972; or from Wacker, such as H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof.

The invention will further be illustrated by the following examples. They are not intended to be exhaustive of all possible variations of the invention.

The KAO BINDER E, a polyester resin, used in the examples below was obtained from Kao Specialties Americas LLC, a part of Kao Corporation, Japan. The blue pigment used in the Examples of this invention came from BLUE LUPRETON SE 1163 from BASF, which consisted of Pigment Blue 15:3 as a flushed pigment 40% loading dispersed in a linear copolymer of fumaric acid and bisphenol A. LICOWAX F wax, an ester of montanic acids, was from Clariant Corporation (Coventry, R.I.). WE-3 wax was from Nippon Oil & Fats (Tokyo, Japan). Silicone waxes AMS-C30 and 2-5088 were obtained from Dow Corning (Midland, Mich.). The commercial LICOWAX F and Silicone waxes were of flake form and they were ground and passed a Mesh No. 100 sieve before use. Hyperdispersants SOLSPERSE 24000 and 9000 were obtained from Noveon (Cleveland, Ohio). TUFTEC™ P2000, commonly termed a compatibilizer, was a polymer of Styrene/(butadiene/butylene) (67/33 wt %) and was purchased from Asahi Kasei Chemicals Corporation (Tokyo, Japan). SAA-103, a styrene-allyl alcohol (80/20 by weight) copolymer, was obtained from Lyondell Chemical Company (Houston, Tex.).

The size and shape of the particles were measured using a Sysmex FPIA-3000 automated particle shape and size analyzer from Malvern Instruments. Samples pass through a sheath flow cell that transforms the particle suspension into a narrow or flat flow, ensuring that the largest area of the particle is oriented towards the camera and that all particles are in focus. The CCD camera captures 60 images every second and these are analyzed in real time. Numerical evaluation of particle shape is derived from measurement of the area of the particle. A number of shape factors are calculated including circularity, aspect ratio and circle equivalent diameter. The particle size distribution was characterized by a Coulter Particle Analyzer. The volume median value (equivalent diameter) from the Coulter measurements was used to represent the particle size of the particles described in these examples.

The toner Q/m ratio was measured using an electrostatic device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture was placed on the bottom metal plate. The sample was then subjected for thirty (30) seconds to a 60 Hz magnetic field and potential of 2000 V across the plates, which causes developer agitation. The toner particles were released from the carrier particles under the combined influence of the magnetic and electric fields and were attracted to and thereby deposited on the upper electrode plate, while the magnetic carrier particles were held on the lower plate. An electrometer measured the accumulated charge of the toner on the upper plate. The toner Q/m ratio in terms of microcoulombs per gram (μC/g) was calculated by dividing the accumulated charge by the mass of the deposited toner taken from the upper plate. TC was calculated by dividing the toner weight by the initial developer sample weight. By reversing the polarity of the applied potential, the amount and Q/m of wrong-sign toner could also be determined.

The so-called "pre-conditioned" carrier is obtained by bottle brushing for 60 minutes a carrier sample mixed with 15% toner to be tested, and stripping off the toner on a development roller. This carrier is then mixed with fresh toner, and Q/m measured (referred to as strip and rebuilt Q/m) to determine whether the charging behavior of the carrier had changed during use.

Example 1

Preparation of Wax Dispersions

To a glass jar containing a mixture of wax and dispersant in ethyl acetate were added zircornia beads (0.8 mm). Wax was used at 10% by weight, and the dispersant at 1% by weight of the total mixture. The container was then placed on a Sweco Powder Grinder and the wax milled for one to three days. Afterwards, the beads were removed by filtration through a screen and the resulting solid particle dispersion was used for toner preparation as follows.

TABLE 1

Wax dispersions in ethyl acetate

| Dispersion | Wax | Dispersant | Solids % |
|---|---|---|---|
| 1-A | WE-3 | SOLSPERSE 24000 | 8.44 |
| 1-B | Licowax F | SOLSPERSE 24000 | 6.14 |
| 1-C | AMS C-30 | SOLSPERSE 24000 | 7.33 |
| 1-D | WE-3 | SOLSPERSE 9000 | 7.35 |
| 1-E | Licowax F | SOLSPERSE 9000 | 7.33 |
| 1-F | AMS C-30 | SOLSPERSE 9000 | 8.19 |
| 1-G | DC 2-5088 | TUFTEC P2000 | 6.89 |
| 1-H | AMS C-30 | TUFTEC P2000 | 8.27 |

Example 2

Comparative

An organic phase dispersion was prepared using 55.88 g of ethyl acetate, 15.44 g of KAO BINDER E, 2.34 g of BASF LUPRETON BLUE SE 1163, and 26.34 g of the WE-3/SOLSPERSE 24000 wax dispersion 1-A. The mixture was stirred overnight with a magnetic stirrer. This organic phase is mixed with an aqueous mixture prepared with 189.03 g of water, 1.224 g of potassium hydrogen phthalate (KHP), 8.00 g of NALCO 1060 and 1.76 g of 10% promoter (poly(adipic acid-comethylaminoethanol)). This mixture was then subjected to very high shear using a Silverson L4R Mixer (sold by Silverson Machines, Inc.) followed by a Microfluidizer sold by Microfluidics. Upon exiting the microfluidizer, the ethyl acetate solvent was removed with a rotary evaporator under reduced pressure. The solid particles were treated with 400 g of a 0.1 N KOH solution at room temperature for 2 hours and then collected by filtration, washed, and dried. The toner particles have a volume median size of 10.6 microns.

Example 3

Comparative

A toner was prepared the same way as in Example 2 except that the organic phase dispersion was prepared using 46.02 g of ethyl acetate, 15.44 g of KAO BINDER E, 2.34 g of BASF LUPRETON BLUE SE 1163, and 36.20 g of the LICOWAX F/SOLSPERSE 24000 wax dispersion 1-B. The collected toner particles have a volume median size of 6.5 microns.

Example 4

Inventive

The procedure in Example 2 was repeated except that the organic phase dispersion was prepared using 51.90 g of ethyl acetate, 15.44 g of KAO BINDER E, 2.34 g of BASF LUPRETON BLUE SE 1163, and 30.33 g of the AMS-C30/SOLSPERSE 24000 wax dispersion 1-C. The toner particles have a volume median size of 7.7 microns.

Example 5

Comparative

The procedure in Example 2 was repeated with the exception that the organic phase dispersion was prepared using 51.99 g of ethyl acetate, 15.44 g of KAO BINDER E, 2.34 g of BASF LUPRETON BLUE SE 1163, and 30.23 g of the WE-3/SOLSPERSE 9000 wax dispersion 1-D. The toner particles have a volume median size of 7.1 microns.

Example 6

Comparative

A toner sample was prepared the same way as in Example 2 except that the organic phase dispersion was prepared using 51.91 g of ethyl acetate, 15.44 g of KAO BINDER E, 2.34 g of BASF LUPRETON BLUE SE 1163, and 30.31 g of the LICOWAX F/SOLSPERSE 9000 wax dispersion 1-E. The toner particles have a volume median size of 6.4 microns.

Example 7

Inventive

A toner sample was prepared the same way as in Example 2 except that the organic phase dispersion was prepared using 55.09 g of ethyl acetate, 15.44 g of KAO BINDER E, 2.34 g of BASF LUPRETON BLUE SE 1163, and 27.14 g of the AMS-C30/SOLSPERSE 9000 wax dispersion 1-F. The toner particles have a volume median size of 6.6 microns.

Example 8

Comparative

A toner sample was prepared the same way as in Example 2 except that the organic phase contained 80.0 g of ethyl acetate, 17.74 g of KAO BINDER E, 2.34 g of BASF LUPRE- TON BLUE SE 1163, and 0.20 g of polymer SAA-103. The resultant toner particles have a volume median size of 6.2 microns.

The particles obtained above were analyzed in terms of shape analysis using a Sysmex FPIA-3000 automated particle shape and size analyzer. The shape of a particle is quantified by the mean circularity and mean aspect ratio as calculated by the Sysmex software. Value of unity indicates perfect sphere, while numbers smaller than one describe irregular shaped particles. Results are listed in the following table (Table 2) and the data indicate that use of these SOLSPERSE hyperdispersants leads to toner particles of irregular shape.

Also included in Table 2 are the lowest fusing temperatures at which toner-offsets are observed. The higher offset temperature when wax is incorporated in the toner is indicative of oil-less fusing capability of the toner. Thus it is understood that the toners prepared with the silicone wax AMS-C30 exhibit oil-less fusing characteristics.

TABLE 2

Toner particle size and shape analysis, and toner fusing performance

| Example | Vol med, μ | Circularity | Aspect Ratio (W/L) | Offset Temperature ° F. |
|---|---|---|---|---|
| 2 (Comparative) | 8.06 | 0.926 | 0.781 | 350 |
| 3 (Comparative) | 6.34 | 0.977 | 0.843 | 330 |
| 4 (Inventive) | 6.61 | 0.939 | 0.778 | 340 |
| 5 (Comparative) | 6.48 | 0.949 | 0.758 | 350 |
| 6 (Comparative) | 5.84 | 0.958 | 0.839 | 350 |
| 7 (Inventive) | 6.16 | 0.958 | 0.810 | 340 |
| 8 (Comparative) | 6.30 | 0.995 | 0.953 | <270 |

Charge Control Properties

Charge properties of the toners are tabulated on Table 3. The triboelectric charge of electrophotographic developers changes with life. This instability in charging level is one of the factors that require active process control systems in electrophotographic printers to maintain consistent print to print image density. It is desirable to have low charge/mass (Q/m) developers that are stable with life. The low Q/m has the advantage of improved electrostatic transfer and higher density capabilities.

TABLE 3

Triboelectrification measurement

| Sample | Time | Q/m μC/g | TC % |
|---|---|---|---|
| 2 (Comparative) | 2' | −23.62 | 8.416 |
| | 10' | −68.57 | 8.317 |
| 3 (Comparative) | 2' | 8.40 | 6.919 |
| | 10' | 6.52 | 5.855 |
| 4 (Inventive) | 2' | −5.74 | 7.886 |
| | 10' | −29.92 | 8.163 |
| 5 (Comparative) | 2' | −3.82 | 7.275 |
| | 10' | 10.67 | 6.780 |
| 6 (Comparative) | 2' | −4.36 | 7.266 |
| | 10' | 22.54 | 7.876 |
| 7 (Inventive) | 2' | −11.04 | 8.898 |
| | 10' | −15.42 | 9.203 |
| 8 (Comparative) | 2' | −33.98 | 6.835 |
| | 10' | −85.80 | 7.707 |
| 9 (Inventive) | 2' | −3.277 | 7.980 |
| | 10' | −3.600 | 8.200 |

The test results from the tables above show that the use of SOLSPERSE 9000 and SOLSPERSE 24000 leads to irregularly shaped toner particles as indicated by the low aspect ratios measured. On the other hand, when silicone wax AMS-C30 is incorporated at 10% by weight as the release agent, the toners exhibit acceptable negative charging behavior. In contrast, use of LICOWAX F or WE-3 together with the SOLSPERSE hyperdispersants causes the toner to charge positively in most cases. The silicone wax AMS-C30 also leads to good release of the fuser roller upon fusing, comparable to the toners containing WE-3 or LICOWAX F.

Example 9

Inventive

An organic phase dispersion was prepared using 42.80 g of ethyl acetate, 13.29 g of KAO BINDER E, 2.043 g of BASF LUPRETON BLUE SE 1163, 0.158 g of SOLSPERSE 9000, and 29.21 g of Wax dispersion 1-G. The organic phase has a solid content of 20% by weight. The mixture was stirred overnight with a magnetic stirrer. This organic phase is mixed with an aqueous mixture prepared with 121.05 g of water, 0.803 g of potassium hydrogen phthalate (KHP), 7.70 g of NALCO 1060 and 1.694 g of 10% promoter solution. This mixture was homogenized with a Silverson L4R Mixer followed by a Microfluidizer. Upon exiting the microfluidizer, the ethyl acetate solvent was removed with a rotary evaporator under reduced pressure. The solid particles were then collected by filtration, washed, and dried.

The toner particles had a volume median size of 6.81μ and an aspect ratio of 0.874. The (hot) offset temperature was very high with this toner (>380° F.) so the toner was extremely good for oil-less fusing applications.

The following comparative example further illustrates the necessity of hyperdispersant in the silicone wax-containing toners for irregular shape.

Example 10

Comparative

An organic phase dispersion was prepared using 48.423 g of ethyl acetate, 13.512 g of KAO BINDER E, 2.043 g of BASF LUPRETON BLUE SE 1163, and 22.522 g of the appropriate wax dispersion (1-H). The organic phase has a solid content of 20% by weight. The mixture was stirred overnight with a magnetic stirrer. This organic phase is mixed with an aqueous mixture prepared with 164.17 g of water, 1.071 g of potassium hydrogen phthalate (KHP), 8.00 g of NALCO 1060 and 1.76 g of 10% promoter (poly(adipic acid-comethylaminoethanol)) solution. This mixture was then subjected to high shear using a Silverson L4R Mixer followed by a Microfluidizer. Upon exiting the microfluidizer, the ethyl acetate solvent was removed with a rotary evaporator under reduced pressure. The solid particles were then collected by filtration, washed, and dried.

The toner particles had a volume median diameter of 5.36μ, and an aspect ratio of 0.915, and were substantially spherical in shape. The offset temperature was high (360° F.) showing the suitability in oil-less fusing applications. This shows that the silicone wax itself does not cause non-spherical shape in the resulting toner while it enables oil-less fusing with the end toner particles.

Testing results for the toners are shown in Table 4.

TABLE 4

Toner particle size and shape analysis, and toner fusing performance

| Example | Vol med, μ | Circularity | Aspect Ratio (W/L) | Offset Temperature ° F. |
|---|---|---|---|---|
| 9 (Inventive) | 6.81 | 0.967 | 0.874 | >380 |
| 10 (Comparative) | 5.36 | 0.995 | 0.915 | 360 |

The invention has been described in detail with particular reference to certain preferred embodiments thereof, but it will be understood that variations and modifications can be effected within the spirit and scope of the invention.

The invention claimed is:

1. A method for the preparation of electrostatographic toner particles of controlled shape comprising the steps of:

a) combining a solvent, a hyperdispersant, and a silicone wax to form a dispersion;

b) mixing the dispersion with a polymer material to form an organic phase;

e) dispersing the organic phase in an aqueous phase comprising a particulate stabilizer and homogenizing the resultant mixture;

d) evaporating the solvent; and e) washing and drying the resultant product.

2. The method of claim 1 wherein a charge control agent is added in step b).

3. The method of claim 1 wherein a pigment is added in step b).

4. The method of claim 1 wherein the solvent is selected from chloromethane, dichloromethane, ethyl acetate, n-propyl acetate, iso-propyl acetate, vinyl chloride, methyl ethyl ketone, trichloromethane, carbon tetrachloride, ethylene chloride, trichloroethane, toluene, xylene, cyclohexanone and 2-nitropropane.

5. The method of claim 1 wherein the solvent is ethyl acetate.

6. The method of claim 1 wherein the particulate stabilizer is selected from the group consisting of highly cross-linked latex polymeric material, and $SiO_2$.

7. The method of claim 1 wherein the amount of particulate stabilizer is between 1 to 15 parts based on 100 parts of total solids in the toner.

8. The method of claim 1 wherein the relationship between the aqueous phase and the organic phase, by volume, ranges from 1:1 to 9:1.

9. The method of claim 1 wherein the amount of wax used is greater than 4 weight percent based on the total weight of the electrophotographic toner.

10. The method of claim 1 wherein the silicone wax is selected from the group consisting of Dow Corning AMS-C30 and Dow Corning 2-5088.

11. The method of claim 1 wherein the polymer material is selected from, olefin homopolymers and copolymers, such as, polyethylene, polypropylene, polyisobutylene and polyisopentylene; polytrifluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers.

12. The method of claim 3 wherein a pigment is selected from the group consisting of $TiO_2$; carbon black such as channel black, furnace black, acetylene black, thermal black, lamp black and aniline black; phthalocyanine pigments such as copper phthalocyanine, mono-chlor copper phthalocyanine, and hexadecachlor copper phthalocyanine; organic pigments such as anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red.

13. The method of claim 3 wherein the pigment is selected from bridged aluminum phthalocyanine and carbon black.

14. A method for the preparation of electrostatographic toner particles of controlled shape comprising the steps of a) combining a solvent, and a silicone wax to form a dispersion;

b) mixing the dispersion with a polymer material and a hyperdispersant to form an organic phase;

c) dispersing the organic phase in an aqueous phase comprising a particulate stabilizer and homogenizing the resultant mixture;

d) evaporating the solvent; and e) washing and drying the resultant product.

15. The method of claim 14 wherein the solvent is selected from chloromethane, dichloromethane, ethyl acetate, n-propyl acetate, iso-propyl acetate, vinyl chloride, methyl ethyl ketone, trichloromethane, carbon tetrachloride, ethylene chloride, trichloroethane, toluene, xylene, cyclohexanone and 2-nitropropane.

16. The method of claim 14 wherein the particulate stabilizer is selected from the group consisting of highly cross-linked latex polymeric material, and $SiO_2$.

17. The method of claim 14 wherein the silicone wax is selected from the group consisting of Dow Corning AMS-C30 and Dow Corning 2-5088.

18. The method of claim 14 wherein the polymer material is selected from, olefin homopolymers and copolymers, such as, polyethylene, polypropylene, polyisobutylene and polyisopentylene; polytrifluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers.

19. The method of claim 14, wherein the hyperdispersant is SOLSPERSE 24000 or SOLSPERSE 9000.

20. The method of claim 1, wherein the hyperdispersant is SOLSPERSE 24000 or SOLSPERSE 9000.

* * * * *